US008074708B2

(12) United States Patent
Sugito et al.

(10) Patent No.: US 8,074,708 B2
(45) Date of Patent: Dec. 13, 2011

(54) HEAT EXCHANGER

(75) Inventors: Hajime Sugito, Nagoya (JP); Hiroyuki Osakabe, Chita-gun (JP); Hirokazu Hirose, Anjo (JP); Takahiro Uno, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/823,827

(22) Filed: Jun. 28, 2007

(65) Prior Publication Data

US 2008/0000626 A1 Jan. 3, 2008

(30) Foreign Application Priority Data

Jun. 29, 2006 (JP) ..... 2006-179046
Nov. 2, 2006 (JP) ..... 2006-298690

(51) Int. Cl.
*F28F 9/02* (2006.01)

(52) U.S. Cl. ..... 165/173; 165/81

(58) Field of Classification Search ..... 165/81, 165/82, 83, 173, 906
See application file for complete search history.

(56) References Cited

U.S. PATENT DOCUMENTS 4,150,556 A 4/1979 Melnyk
4,234,041 A * 11/1980 Melnyk ..... 165/173
4,316,503 A 2/1982 Kurachi et al.
4,893,391 A 1/1990 Zobel et al.
5,297,624 A 3/1994 Haussmann et al.
5,492,172 A * 2/1996 Laveran et al. ..... 165/173
5,501,270 A * 3/1996 Young et al. ..... 165/151
5,605,191 A 2/1997 Eto et al.
5,797,448 A * 8/1998 Hughes et al. ..... 165/151
6,082,439 A 7/2000 Kato et al.
6,904,958 B2 * 6/2005 Ozaki et al. ..... 165/67
6,988,544 B2 1/2006 Ozaki et al.
7,331,382 B2 * 2/2008 Misiak et al. ..... 165/173
2007/0012425 A1 1/2007 Sugito et al.

FOREIGN PATENT DOCUMENTS

JP 2000-213889 8/2000

OTHER PUBLICATIONS

Office Action dated Jul. 15, 2009 from the German patent office in the corresponding patent application No. 10 2007 028 792.7.

* cited by examiner

*Primary Examiner* — Teresa Walberg
(74) *Attorney, Agent, or Firm* — Harness, Dickey & Pierce, PLC

(57) ABSTRACT

A heat exchanger includes tubes and a tank. The tubes extend in a first direction, and are stacked in a second direction. The tank has a tube insertion plate part, and is arranged at an end portion of the tubes. The tube insertion plate part has tube holes in which the tubes are inserted, and ribs extending in a third direction that is approximately perpendicular to the first direction and the second direction. The tube hole has end portions in the third direction. The rib are arranged to overlap with the end portion of the tube hole in the second direction, and to provide a deformable part to be deformable in the first direction. The deformable part is located in the tube insertion plate part outside of the ribs in the third direction.

22 Claims, 10 Drawing Sheets

HEAT EXCHANGER

CROSS REFERENCE TO RELATED APPLICATIONS

This application is based on Japanese Patent Applications No. 2006-179046 filed on Jun. 29, 2006 and No. 2006-298690 filed on Nov. 2, 2006, the contents of which are incorporated herein by reference in its entirety.

BACKGROUND OF THE INVENTION

1. Field of the Invention

The present invention relates to a heat exchanger which can be used for a radiator, for example.

2. Description of the Related Art

Conventionally, a heat exchanger includes a plurality of tubes and a plurality of corrugate fins, which are alternately stacked to form a core part. The heat exchanger further includes tanks arranged at longitudinal ends of the tubes. Each of the tanks includes a core plate having tube holes in which the tubes are inserted, and a tank body fixed to the core plate to provide a space in the tank with the core plate. The core plate has a first wall part (tube insertion plate part) having the tube holes. At an outer peripheral portion of the first wall part, a second wall part, which is arranged approximately perpendicularly to the first wall part, is formed. In addition, two inserts (side plates) are arranged at two ends of the core part in a stacking direction in which the tubes and the corrugate fins are stacked.

In such a heat exchanger, when a temperature of a tube 310 is different from those of adjacent tubes, a tube insertion plate part 322 of a core plate 320 may be bent in a longitudinal direction of the tube 310 (direction X), as shown in FIG. 19. Thereby, a stress may concentrate at bases of the tube 310, i.e., end portions of the tube 310 in a width direction (direction Z), which are bending points.

For example, JP-A-2000-213889 discloses a heat exchanger having a plurality of ribs arranged on a first wall part of the core plate approximately parallel to a plurality of tube holes in which a plurality of tubes are inserted. In addition, two ends of each of the ribs are connected to a second wall part of the core plate, for increasing a rigidity of the core plate, and restricting a stress concentration at end portions of the tubes in a tube width direction (tube major direction).

However, when the core plate has the ribs, the core plate is difficult to be deformed in the longitudinal direction of the tubes, thereby a high stress may be generated over the tubes in the tube width direction. In addition, when the ends of the ribs are connected to the second wall part of the core plate, a length of the ribs in the width direction of the tube is long. Thereby, when the core plate is formed by a press working, a formability of the ribs is reduced.

Furthermore, a heat exchanger having a plurality of burring parts J221*a* is shown in FIG. 20. As shown in FIG. 20, the burring parts J221*a* are arranged at inner peripheral edges of tube holes J221 in which tubes are inserted, and insert holes J222 in which inserts are inserted. The burring parts J221*a* have tubular shapes protruding to an inside of a tank. Therefore, the rigidity of a core plate J20 is increased.

Generally, when protruding dimensions of the ribs and burring parts from the first wall part of the core plate are large, the rigidity of the core plate becomes large. However, as the protruding dimensions of the ribs and burring parts are large, the formability of the ribs and the burring parts are reduced.

SUMMARY OF THE INVENTION

In view of the foregoing problems, it is an object of the present invention to provide a heat exchanger which can restrict a stress concentration at ends portions of tube in a tube width direction (tube major direction) while a formability of a core plate is improved.

A heat exchanger according to a first aspect of the invention includes a plurality of tubes and a tank. Each of the tubes has a flat shape, extends in a first direction, and is stacked in a second direction. The tank has a tube insertion plate part, and is arranged at an end portion of the plurality of tubes in the first direction, to communicate with the plurality of tubes. The tube insertion plate part has a plurality of tube holes in which the plurality of tubes are inserted, and a plurality of ribs each of which extends in a third direction that is approximately perpendicular to the first direction and the second direction. Each of the plurality of ribs has a length in the third direction that is shorter than a length of each of the plurality of tube holes in the third direction. The tube holes have first and second hole end portions in the third direction. The ribs are arranged in the tube insertion plate part to overlap with at least one of the first and second hole end portions in the second direction, and to provide a deformable part to be deformable in the first direction. The deformable part is located in the tube insertion plate part outside of the ribs in the third direction.

When a temperature of one of the tube is different from that of an adjacent tube, the ribs restrict a deformation of the portions of the tube holes, thereby a stress concentration at the end portions of the tubes in the third direction is restricted. In addition, a thermal strain of the tube is absorbed by a deformation of the deformable part. Furthermore, the length of the ribs in the third direction is short, thereby a formability of the ribs is improved.

A heat exchanger according to a second aspect of the invention includes a plurality of tubes and a tank. Each of the tubes has a flat shape, extends in a first direction, and is stacked in a second direction. The tank has a tube insertion plate part, and is arranged at an end portion of the plurality of tubes in the first direction, to communicate with the plurality of tubes. The tube insertion plate part has a plurality of tube holes in which the plurality of tubes are inserted, and a plurality of ribs each of which extends in a third direction that is approximately perpendicular to the first direction and the second direction. The tube hole has first and second hole end portions in the third direction. The ribs are arranged in the tube insertion plate part to protrude outside in the third direction by a predetermined length compared with at least one of the first and second hole end portions, and to provide a deformable part to be deformable in the first direction. The deformable part is located in the tube insertion plate part outside of the ribs in the third direction. In addition, the predetermined length is set to be about in a range of 4 to 8 mm.

When the ribs protrude outside in the third direction by the predetermined length about in the range of 4 to 8 mm, compared with at least one of the first and second hole end portions of the tube holes, the ribs restrict a stress concentration at the end portions of the tube holes in the third direction. In addition, a thermal strain of the tube is absorbed by a deformation of the deformable part located outside of the ribs.

A heat exchanger according to a third aspect of the invention includes a plurality of tubes, and a tank. Each of the tubes has a flat shape, extends in a first direction, and is stacked in a second direction. The tank has a tube insertion plate part, and is arranged at an end portion of the plurality of tubes in the first direction, to communicate with the plurality of tubes. The tube insertion plate part has a plurality of tube holes in which the plurality of tubes are inserted, and a plurality of ribs arranged outside of ends of the tube holes in a third direction that is approximately perpendicular to the first direction and the second direction.

In this case, a stress generated in the vicinity of end portions of the tube holes in a tube width direction (corresponding to a third direction approximately perpendicular to the first and second directions) are dispersed to the ribs, thereby the ribs restrict a deformation of the end portions of the tube holes due to a difference in temperature of the tubes. Therefore, a stress concentration at the end portions of the tubes in the tube width direction is restricted. In addition, a length of the ribs in the tube width direction becomes short, thereby a formability of the ribs is improved.

A heat exchanger according to a fourth aspect of the invention includes a core part and a tank. The core part includes a plurality of tubes each having a flat shape, extending in a first direction, and stacked in a second direction. The tank is arranged at end portion of the plurality of tubes in the first direction, and has a core plate connected to the plurality of tubes and a tank body arranged to form a tank space with the core plate. The core plate has a tube insertion plate part having a plurality of tube holes and a plurality of burring parts located at inner peripheral edges of at least a part of the tube holes. The tubes are inserted in the tube holes, respectively, to communicate with the tank space. The burring part protrudes in the first direction. Furthermore, the inner peripheral edge has a cut portion which cuts and removes a part of the burring part.

A rigidity of surrounding areas of the tube holes in the tube insertion plate part is increased by the burring parts. Thus, when a strain is generated in the tubes, the burring parts restrict a deformation of the end portions of the tube holes in a tube width direction, thereby a stress concentration at end portions of the tubes in a tube width direction is restricted.

A heat exchanger according to a fifth embodiment of the invention includes a core part, a tank, and an insert. The core part includes a plurality of tubes each having a flat shape, extending in a first direction, and stacked in a second direction. The tank is arranged at an end portion of the plurality of tubes in the first direction, and has a core plate connected to the plurality of tubes and a tank body arranged to form a tank space with the core plate. The insert is arranged at an end portion of the core part approximately parallel to the first direction, and an end of the insert is connected to the core plate to reinforce the core part. The core plate has a tube insertion plate part having a plurality of tube holes, an insert hole, and a plurality of burring parts. The tubes are inserted in the tube holes, respectively, to communicating with the tank space. The insert is inserted in the insert hole to be connected to the core plate. The burring part protrudes in the first direction, and is arranged only at an inner peripheral edge of tube hole.

In general, a thickness of the insert is larger than that of the tubes, thereby the insert is hardly damaged by a stress concentration. Therefore, when the burring parts are arranged only at the inner peripheral edges of a part of the tube holes, a stress concentration at end portions of the tubes in the tube width direction is restricted while a formability of the core plate is improved.

BRIEF DESCRIPTION OF THE DRAWINGS

Additional objects and advantages of the present invention will be more readily apparent from the following detailed description of preferred embodiments when taken together with the accompanying drawings. In the drawings.

DETAILED DESCRIPTION OF THE PREFERRED EMBODIMENTS

First Embodiment

Figure 1:
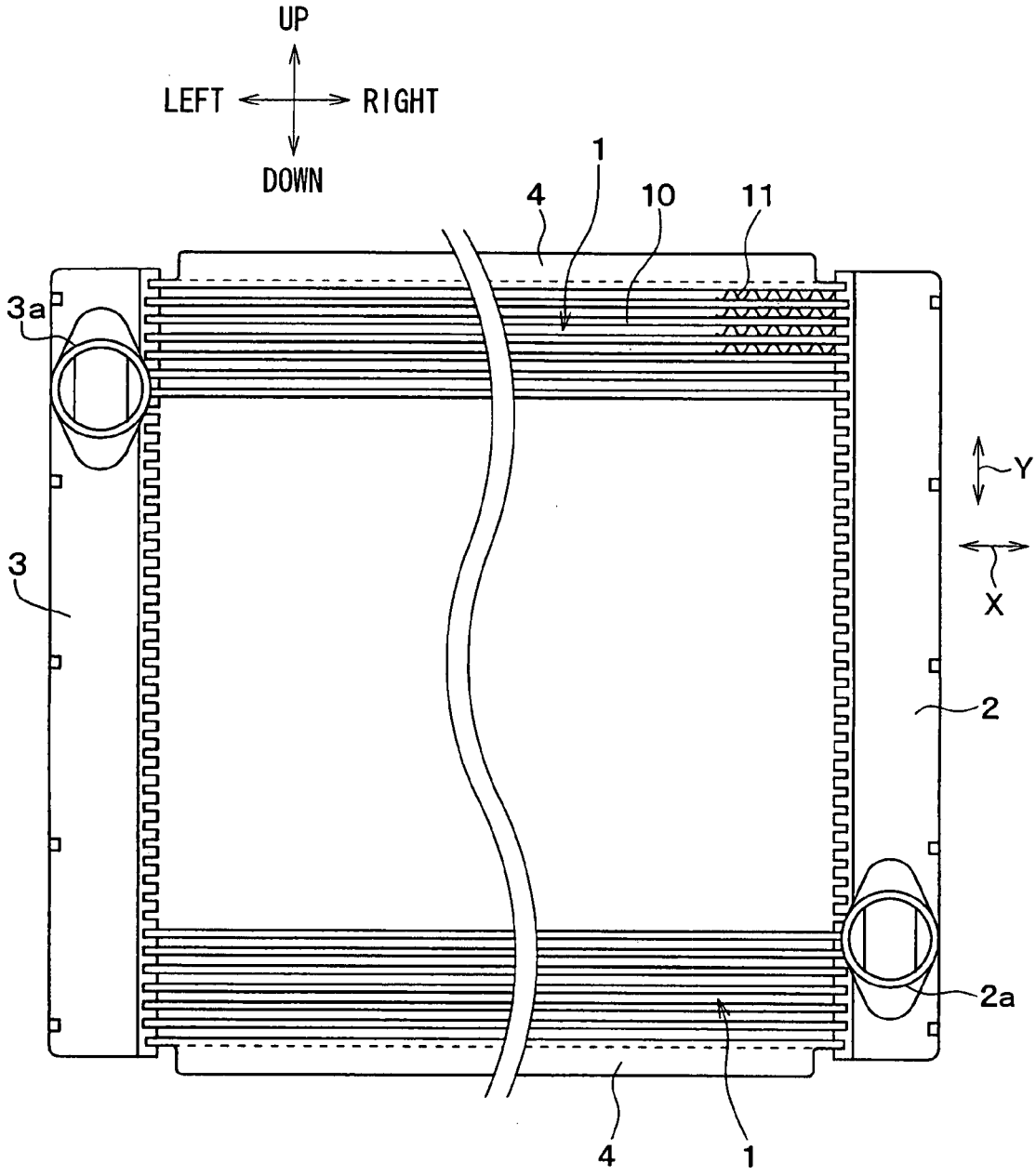
FIG. 1 is a front view of a heat exchanger according to a first embodiment of the invention.

A heat exchanger according to a first embodiment of the invention can be used for a radiator, for example, for cooling a water-cooled internal combustion engine. As shown in FIG. 1, the heat exchanger includes a core part 1 having an approximately rectangular solid shape. The core part 1 includes a plurality of tubes 10 and a plurality of corrugate fins 11 which are alternately stacked in an up-down direction (tube stacking direction Y) in FIG. 1.

The corrugate fins 11 have corrugate shapes, and are made of an aluminum alloy, for example. The corrugate fins 11 are arranged for accelerating a heat exchange between air and cooling water (coolant). The tubes 10 define therein water passages through which cooling water for the water-cooled internal combustion engine (not shown) flows. For example, the tubes 10 are made of aluminum alloy plates, which are bent into predetermined shapes and weld or brazed, for example.

Figure 2:
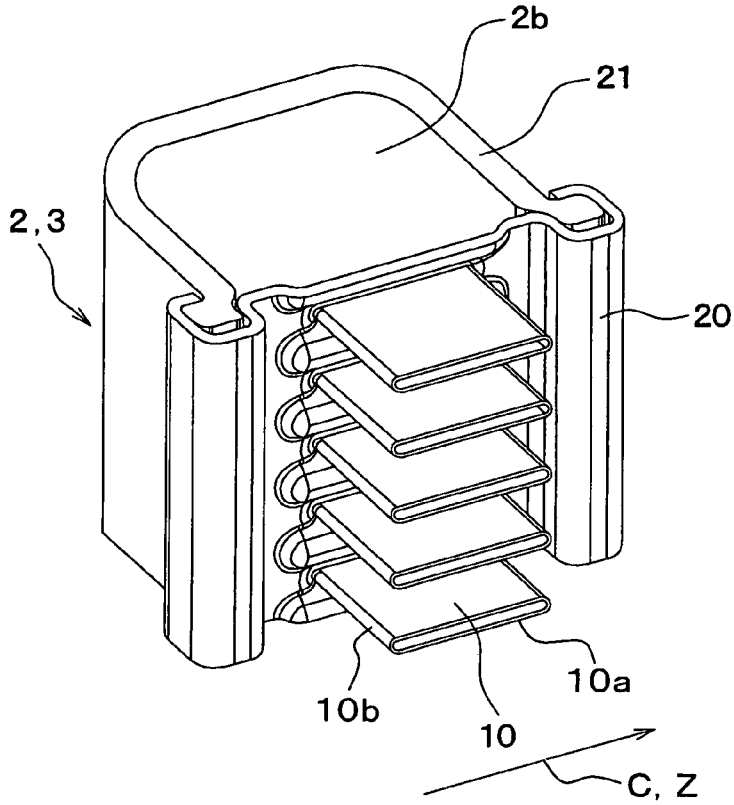
FIG. 2 is a perspective cross-sectional view showing a tank, a core plate, and tubes in the heat exchanger according to the first embodiment.

In the heat exchanger in FIG. 1, a longitudinal direction of the tubes 10 (i.e., tube longitudinal direction X, first direction) approximately corresponds to a horizontal direction (right-left direction). The tubes 10 have flat shapes in cross section so that a tube major direction Z approximately corresponds to a direction C of airflow, as shown in FIG. 2. The tube major direction Z is approximately perpendicular to the tube longitudinal direction X and the tube stacking direction Y (second direction).

Each of the tubes 10 includes a pair of opposite straight portions 10*a* and a pair of opposite arc portions 10*b*, as shown in FIG. 2. The pair of straight portions 10*a* has a straight shape in cross-section approximately perpendicular to the tube longitudinal direction X, and is elongated and arranged to be approximately parallel to the tube major direction Z. The pair of arc portions 10*b* has arc shapes in cross-section approximately perpendicular to the tube longitudinal direction X, and is arranged to connect ends of the pair of straight portions 10*a* in the tube major direction Z.

A first tank 2 and a second tank 3 are arranged at two ends of the tubes 10 in the tube longitudinal direction X. The tanks 2 and 3 extend to a direction approximately perpendicular to the tube longitudinal direction X, and have spaces therein. The both ends of the tubes 10 in the tube longitudinal direction X are inserted in tube holes 221 provided in the tanks 2 and 3 so that inner passages of the tubes 10 communicate with the spaces in the tanks 2 and 3.

The first tank 2 is arranged for distributing hot cooling water from an engine to the tubes 10. The first tank 2 has an inlet pipe 2*a* connected with a cooling-water outlet of the internal combustion engine through a first hose (not shown).

The second tank 3 is arranged for collecting cooling water cooled by heat exchanging with air. The cooling water flowing out of the second tank 3 is circulated to the engine. The second tank 3 has an outlet pipe 3*a* connected with a cooling-water inlet of the internal combustion engine through a second hose (not shown).

At two ends of the core part 1 in the tube stacking direction Y, two inserts 4 are (side plates) arranged for reinforcing the core part 1. The inserts 4 are made of an aluminum alloy, for example. The inserts 4 extend to a direction approximately parallel to the tube longitudinal direction X, and ends of the inserts 4 in the tube longitudinal direction X are connected with the tanks 2 and 3. The inserts 4 may have a thickness larger than that of the tubes 10.

As shown in FIG. 2, each of the tanks 2 and 3 includes a core plate 20 in which the tubes 10 and inserts 4 are inserted, a tank body 21 for forming a tank space 2*b* with the core plate 20, and a packing (not shown).

For example, the core plate 20 is made of an aluminum alloy, the tank body 21 is made of a resin such as glass-fiber-reinforced nylon 66, and the packing is made of a rubber. The packing is put between the core plate 20 and the tank body 21, and a plurality of projection pieces 251 of the core plate 20 is pressed against the tank body 21, thereby the projection pieces 251 are plastically deformed and the tank body 21 is fixed to the core plate 20.

As shown in FIGS. 3A to 5, the core plate 20 has a tube insertion plate part 22 to which the tubes 10 are connected. At the whole circumference of the tube insertion plate part 22, a groove 20*a* having an approximately rectangular shape is provided. When the tank body 21 and the core plate 20 are fixed, an end of the tank body 21 and the packing are inserted in the groove 20*a*.

The groove 20*a* is formed with an inner wall 23, a bottom wall 24, and an outer wall 25. The inner wall 23 is bent approximately vertically from an outer peripheral portion of the tube insertion plate part 22 and protrudes in the tube longitudinal direction X from the bottom wall 24. The bottom wall 24 is bent approximately vertically from the inner wall 23 and extends to the tube stacking direction Y, or the tube major direction Z. The outer wall 25 is bent approximately vertically from the bottom wall 24 and protrudes in the tube longitudinal direction X from the bottom wall 24. The projection pieces 251 are formed at an end portion of the outer wall 25.

The tube insertion plate part 22 of the core plate 20 has a plurality of tube holes 221 in which the tubes 20 are inserted and brazed. In addition, the tube insertion plate part 22 has two insert holes 222 in which the inserts 4 are inserted and brazed. The insert holes 222 are provided at two end portions of the tube insertion plate part 22 in the tube stacking direction Y. The tube holes 221 and the insert holes 222 are formed into elongated shapes extending in the tube major direction Z by a punching process, for example. In addition, the tube insertion plate part 22 may be provided with a plurality of burring parts 221*a* arranged at inner peripheral edges of the tube holes 221. Each of the burring parts 221*a* has a tubular shape having a cross section similar to those of the tubes 10, and projecting to an inside of each of the tanks 2 and 3 (i.e., projecting outside of the tube 10 in the tube longitudinal direction X), for example.

Furthermore, the tube insertion plate part 22 has a plurality of ribs 223 arranged between adjacent tube holes 221, and between the tube holes 221 and the insert holes 222 in the tube stacking direction Y. The ribs 223 have convex shape extending in the tube major direction Z and projecting from the tube insertion plate part 22 to an outside of each of the tanks 2 and 3. The ribs 223 are formed by a press working, for example. When a portion between each of the adjacent tube holes 221 is set to be an intermediate portion, all of the intermediate portions is provided with a pair of the ribs 223 arranged in the tube major direction Z.

A length L1 of the ribs 223 in the tube major direction Z is set to be shorter than a length L2 of the tube holes 221 in the tube major direction Z. In addition, when the tube insertion plate part 22 is viewed from the tube stacking direction Y, end portions of the tube holes 221 in the tube major direction Z and the ribs 223 overlap. That is, the end portions of the tube holes 221 in the tube major direction Z are overlapped with the ribs 223, in the tube stacking direction Y.

Furthermore, end portions of the ribs 223 are away from the inner wall 23. Thus, the tube insertion plate part 22 has two flat surfaces 224 located at outsides of the tube holes 221, the insert holes 222, and the ribs 223 in the tube major direction Z. The flat surfaces 24 extend over the tube insertion plate part 22 in the tube stacking direction Y. The flat surfaces 224 are deformable parts which are easily deformed in the tube longitudinal direction X.

As described above, in the tube stacking direction Y, the end portions of the tube holes 221 in the tube major direction Z and the ribs 223 having a high rigidity overlap with each other with a clearance therebetween. Thus, when a temperature of one of the tubes 10 is different from those of adjacent tubes 10, the ribs 223 prevent a deformation of the end portions of the tube holes 221 in the tube major direction Z, thereby a stress concentration at the end portions of the tubes 10 in the tube major direction Z is restricted.

In addition, the flat surfaces 224 located at the outsides of the tube holes 221, insert holes 222, and the ribs 223 are easily deformed in the tube longitudinal direction X. Thus, when a difference in temperature between the tubes 10 is large, the core plate 20 is deformed in the tube longitudinal direction X due to deformations of the flat surfaces 224, and a thermal strain of the tubes 10 is absorbed by a deformation of the core plate 20.

Furthermore, the length L1 of the ribs 223 is set to be a sufficient length such that the ribs 223 reduce the deformation of the end portions of the tube holes 221 in the tube major direction Z. In addition, the length L1 of the ribs 223 is set, thereby a formability of the ribs 223 is improved.

When a ratio of the length L1 of the ribs 223 to the length L2 of the tube holes 221 is set to be about in a range of $0.08 \leqq (L1/L2) \leqq 0.2$, the ribs 223 can sufficiently reduce the deformation of the end portions of the tube holes 221 while the formability of the ribs 223 is improved.

In addition, the pair of the ribs 223 is located between adjacent tube holes 221 and insert holes 222 in the tube stacking direction Y. In other words, the ribs 223 are arranged adjacent to the end portions of all of the tube holes 221, which are adjacent in the tube stacking direction Y, thereby each end portion of all of the tube holes 221 in the tube major direction Z are restricted from deforming.

Second Embodiment

Figure 3A:
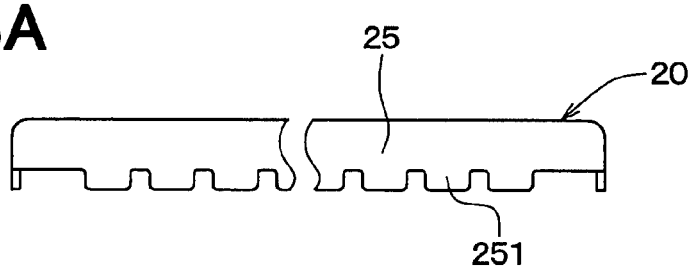
FIG. 3A is a front view of the core plate.
Figure 3B:
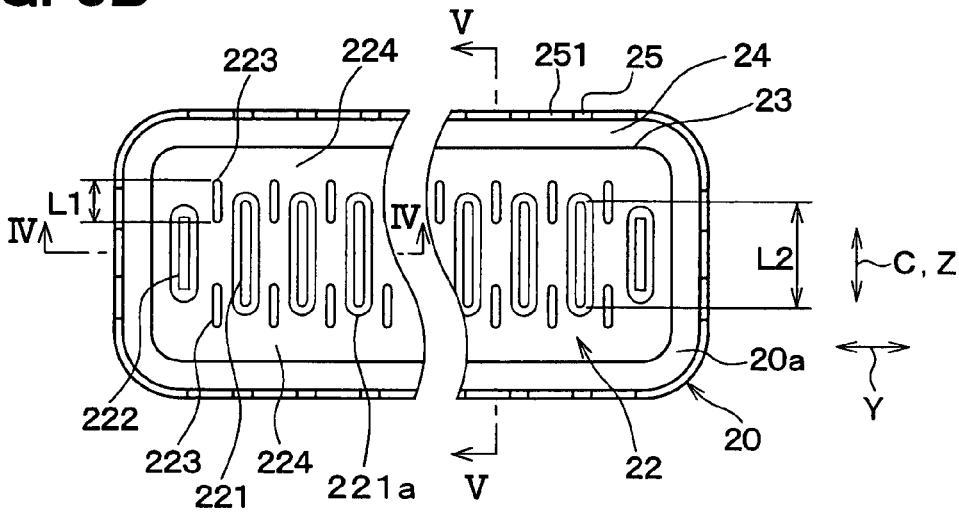
FIG. 3B is a bottom view of the core plate, according to the first embodiment.
Figure 4:
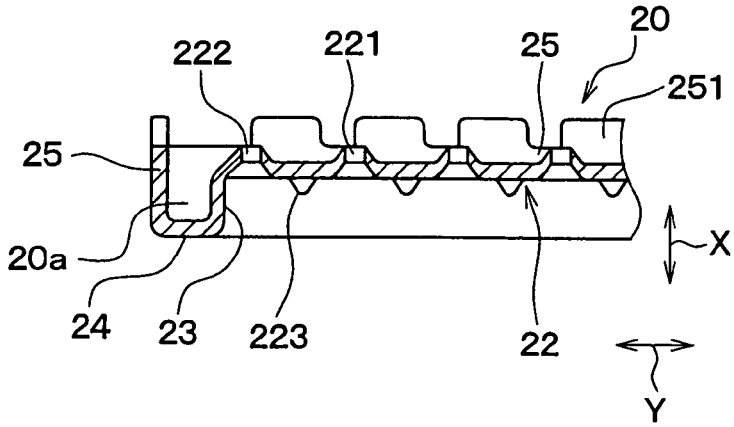
FIG. 4 is a cross-sectional view of the core plate taken along line IV-IV in FIG. 3B.
Figure 5:
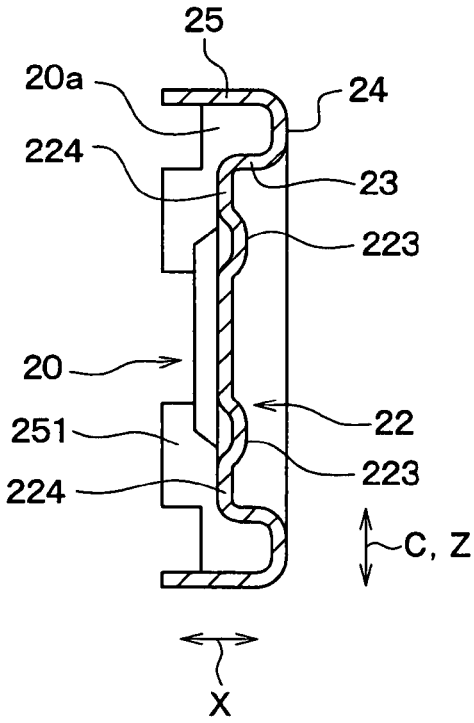
FIG. 5 is a cross-sectional view of the core plate taken along line V-V in FIG. 3B.
Figure 6:
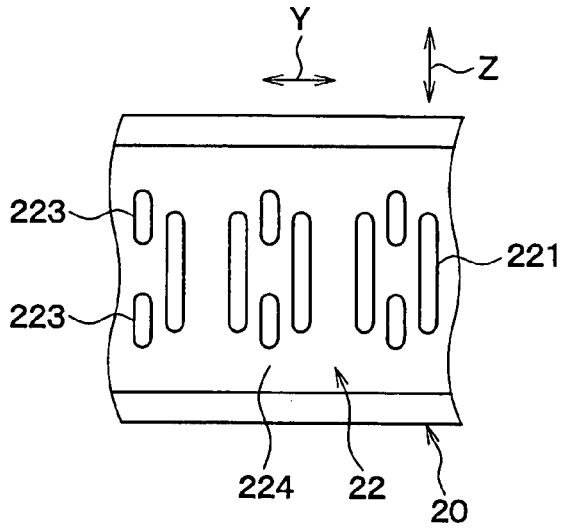
FIG. 6 is a schematic diagram showing a part of a core plate in a heat exchanger according to a second embodiment of the invention.

In the core plate 20 of FIG. 3B, each of the intermediate portions between the tube holes 221 and the insert holes 222 in the tube stacking direction Y is provided with the pair of the ribs 223. Alternatively, a part of the intermediate portions may be provided with the pair of the ribs 223. For example, first intermediate portions each of which is provided with the pair of the ribs 223 and second intermediate portions without any ribs 223 may be alternately arranged in the tube stacking direction Y, as shown in FIG. 6. In other words, the pair of the ribs 223 may be arranged alternately in the intermediate portions in the tube stacking direction Y.

Alternatively, one of the first intermediate portions provided with the pair of the ribs 223 and two of the second intermediate portions without any ribs 223 may be alternately arranged in the tube stacking direction Y. In other words, the pair of the ribs 223 may be arranged at one of every three adjacent intermediate portions in the tube stacking direction. In this case, a number of the ribs 223 is reduced, thereby the formability of the ribs 223 is improved compared with a case where the pair of the ribs 223 is arranged at each of the intermediate portions.

Third Embodiment

Figure 7:
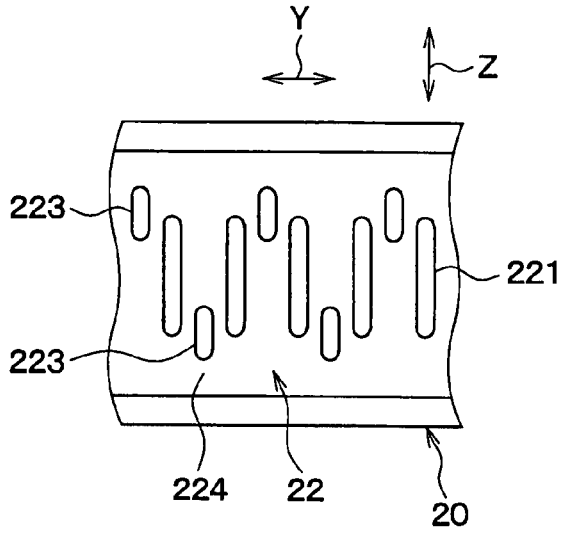
FIG. 7 is a schematic diagram showing a part of a core plate in a heat exchanger according to a third embodiment of the invention.

In the core plate 20 of FIG. 3B, each of the intermediate portions between the tube holes 221 and the insert holes 222 in the tube stacking direction Y is provided with the pair of the ribs 223. Alternatively, each of the intermediate portions may be provided with one rib 223 at one end side of the tube holes 221 in the tube major direction Z. For example, one of third intermediate portions having one rib 223 on a first end side of the tube holes 221, and one of fourth intermediate portions having one rib 223 on a second end side of the tube holes 221 may be alternatively arranged, as shown in FIG. 7. Here, the first end side of the tube holes 221 is opposite to the second end side of the tube holes 221 in the tube major direction Z. Also in this case, the number of the ribs 223 is reduced, thereby the formability of the ribs 223 is improved compared with the case where the pair of the ribs 223 is arranged at each of intermediate portions.

Fourth Embodiment

In the core plate 20 of FIG. 3B, the ribs 223 are arranged in such a manner that, in the tube stacking direction Y, the end portions of the tube holes 221 in the tube major direction Z and the ribs 223 overlap with each other. However, the end portions of the tube holes 221 in the tube major direction Z and the ribs 223 are not required to overlap with each other in the tube stacking direction Y.

Figure 8:
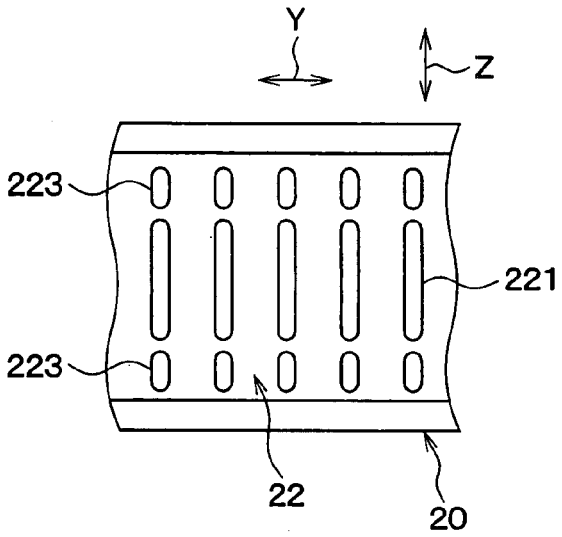
FIG. 8 is a schematic diagram showing a part of a core plate in a heat exchanger according to a fourth embodiment of the invention.

For example, the ribs 223 may be arranged outsides of the end portions of the tube holes 221 in the tube major direction Z, to be lined with the tube holes 221 in the tube major direction Z. Each pair of the ribs 223 may be aligned with each of the tube holes 221 to have a distance between them in the tube major direction Z, as shown in FIG. 8.

Also in this case, a stress generated in the vicinity of the end portions of the tube holes 221 in the tube major direction Z are dispersed to the ribs 223, thereby the ribs 223 restrict the deformation of the end portions of the tube holes 221. As a result, a stress concentration at the both end portions of the tubes 10 is restricted.

In this embodiment, the length L1 of the ribs 223 in the tube major direction Z is short, thereby the formability of the ribs 223 is improved. Furthermore, the ribs 223 are easily arranged even when a distance between adjacent tube holes 221 is small.

Fifth Embodiment

Figure 9A:
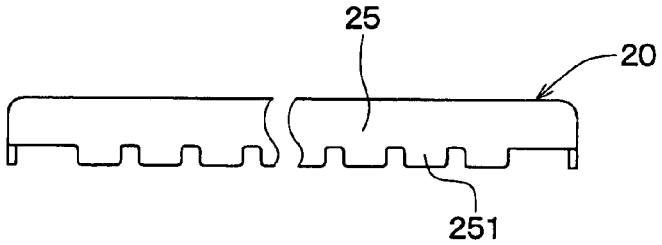
FIG. 9A is a front view of a core plate.

A core plate 20 for a heat exchanger according to a fifth embodiment of the invention will be described with reference to FIGS. 9A-10. The tube insertion plate part 22 of the core plate 20 has a plurality of burring parts 221*a* arranged at the inner peripheral edges of the tube holes 221. Each of the burring parts 221*a* has a tubular shape having a cross section similar to those of the tubes 10, and projecting to the inside of each of the tanks 2 and 3 (i.e., projecting outside of the tube 10 in the tube longitudinal direction X). The rigidity of surrounding areas of the tube holes 221 in the tube insertion plate part 22 is increased by the burring parts 221*a*. In contrast, the burring part 221*a* is not arranged at the insert holes 222.

Furthermore, the tube insertion plate part 22 has a plurality of ribs 223 arranged between adjacent tube holes 221, and between the tube holes 221 and the insert holes 222. The ribs 223 have convex shapes extending in the tube major direction Z and protruding from the tube insertion plate part 22 to an outside of each of the tanks 2 and 3. The ribs 223 are formed by a press working, for example.

The extending length L1 of the ribs 223 is set to be longer than the length L2 of the tube holes 221 and a length of the insert holes 222 in the tube major direction Z. In addition, end portions of the ribs 223 in the tube major direction Z is positioned outsides of the end portions of the tube holes 221 and the insert holes 222 in the tube major direction Z.

Furthermore, the end portions of the ribs 223 are away from the inner wall 23. Thus, the tube insertion plate part 22 has two flat surfaces 224 located at outsides of the tube holes 221, the insert holes 222, and the ribs 223 in the tube major direction Z. The flat surfaces 224 extend over the tube insertion plate part 22 in the tube stacking direction Y. The flat surfaces 224 are deformable parts which are easily deformed in the tube longitudinal direction X. Thus, when a difference in temperature between the tubes 10 is large, the core plate 20 is deformed in the tube longitudinal direction X due to deformations of the flat surfaces 224, and a thermal strain of the tubes 10 is absorbed by a deformation of the core plate 20, thereby a stress is reduced at the tubes 10 in the tube major direction Z.

As described above, the burring parts 221*a* are arranged at inner peripheral edges of the tube holes 221, thereby the rigidity of the surrounding areas of the tube holes 221 in the tube insertion plate part 22 is increased. Thus, when a temperature of one of the tubes 10 is different from those of adjacent tubes 10, the burring parts 221*a* restrict a deformation of the end portions of the tube holes 221, thereby a stress concentration at the end portions of the tubes 10 in the tube major direction Z is restricted.

Furthermore, the burring parts 221*a* are arranged at only the tube holes 221, but are not required to be arranged at the insert holes 222, thereby the formability of the core plate 20 is improved. In addition, the thickness of the inserts 4 is thicker than that of the tubes 10, thereby the inserts 4 are hardly damaged by a stress concentration. Therefore, a stress concentration at the end portions of the tubes 10 in the tube major direction Z is restricted. As a result, the end portions of the tube holes 221 in the tube major direction Z are restricted from deforming while the formability of the are plate 20 is improved.

Sixth Embodiment

Figure 9B:
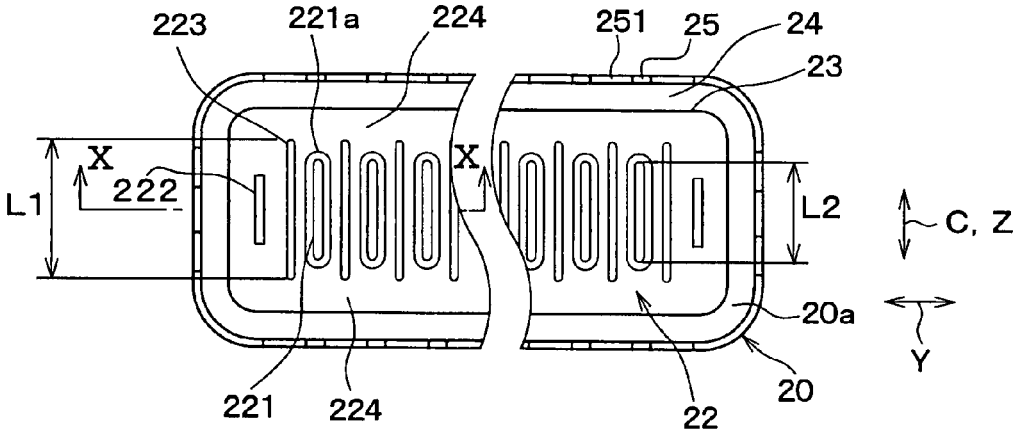
FIG. 9B is a bottom view of the core plate, in a heat exchanger according to a fifth embodiment of the invention.
Figure 10:
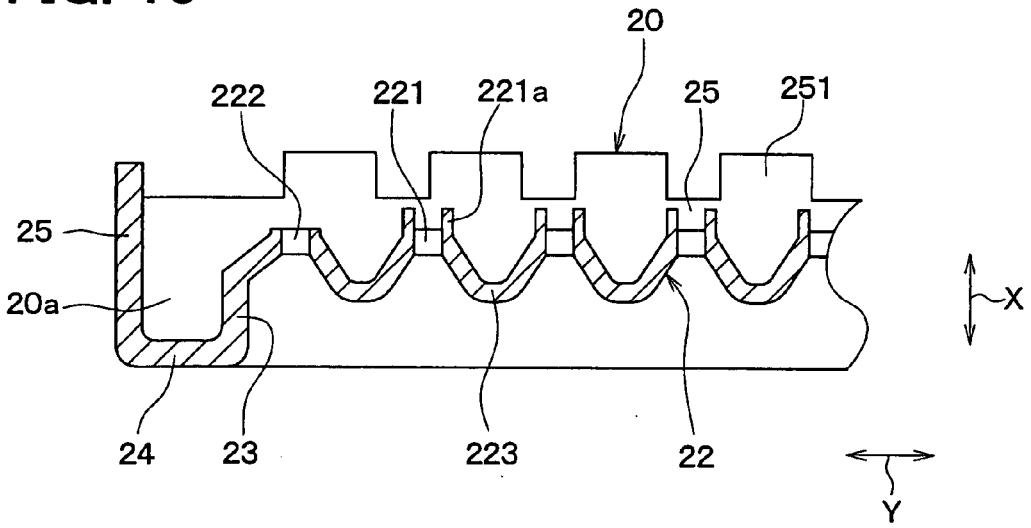
FIG. 10 is a cross-sectional view of the core plate taken along line X-X in FIG. 9B.
Figure 11:
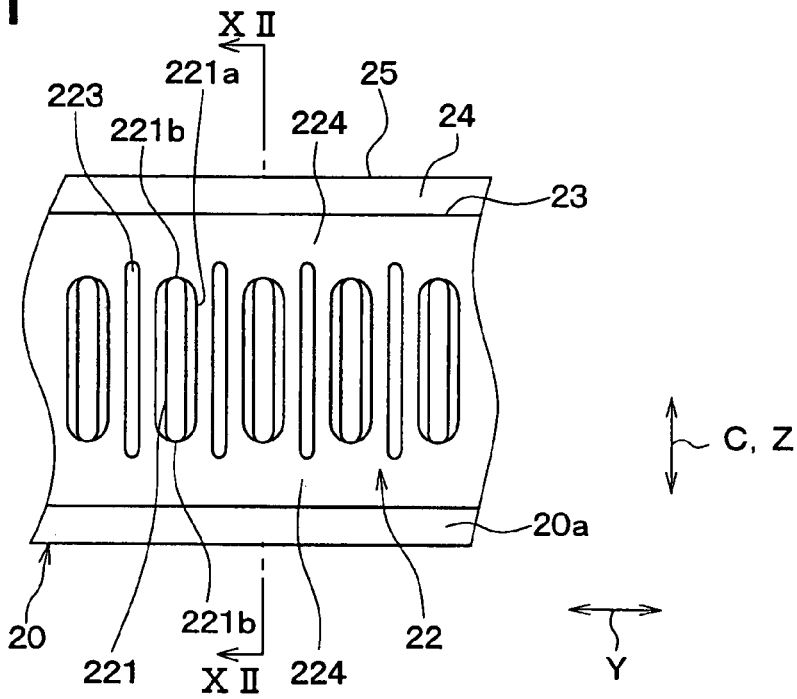
FIG. 11 is a bottom view showing a part of a core plate in a heat exchanger according to a sixth embodiment of the invention.
Figure 12:
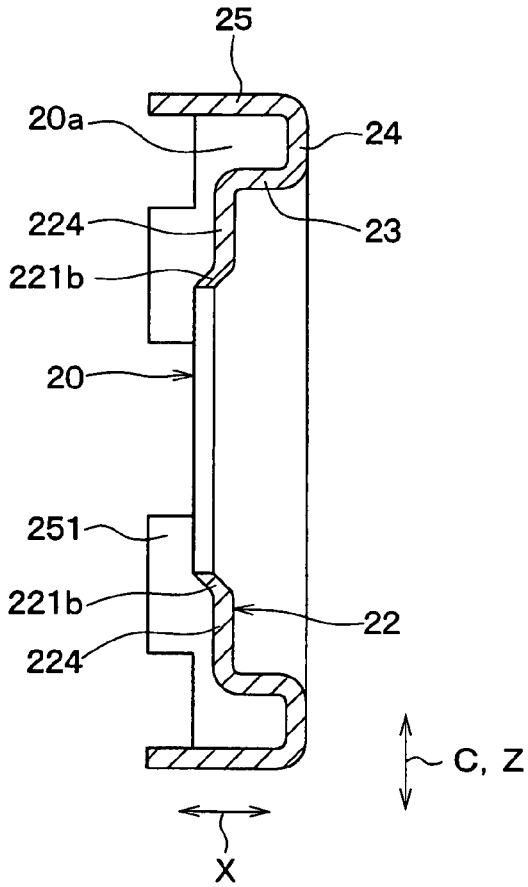
FIG. 12 is a cross-sectional view of the core plate taken along line XII-XII in FIG. 11.

The burring parts 221*a* in FIGS. 9B and 10 are arranged at the whole circumference of the inner peripheral edges of the tube holes 221. Alternatively, the burring parts 221*a* may be arranged at partially on the inner peripheral edges of the tube holes 221. For example, cut portions 221*b* may be provided at portions of the inner peripheral edges corresponding to the arc portions 10*b* of the tubes 10, as shown in FIGS. 11 and 12.

When the burring parts 221*a* are formed by a press working, a crack may be generated in the burring parts 221*a*. However, when the cut portions 221 bare provided by cutting a part of the burring part 221*a* in advance, a crack of the burring parts 221*a* is hardly caused, and the formability of the core plate 20 is improved.

In addition, a crack of the burring parts 221*a* in the press working is particularly generated in the portions corresponding to the arc portions 10*b* of the tubes 10. Therefore, when the cut portions 221*b* are provided at the portions of the burring parts 221*a* corresponding to the arc portions 10*b* in advance, a crack of the burring parts 221*a* is restricted, and the formability of the core plate 20 is more improved. Furthermore, even when the portions of the burring parts 221*a* corresponding to the arc portions 10*b* are cut, the burring parts 221*a* can restrict a stress concentration at the end portions of the tubes 10 in the tube major direction Z. Therefore, a stress concentration at the end portions of the tubes 10 in the tube major direction Z is restricted while the formability of the core plate 20 is improved.

Seventh Embodiment

Figure 13:
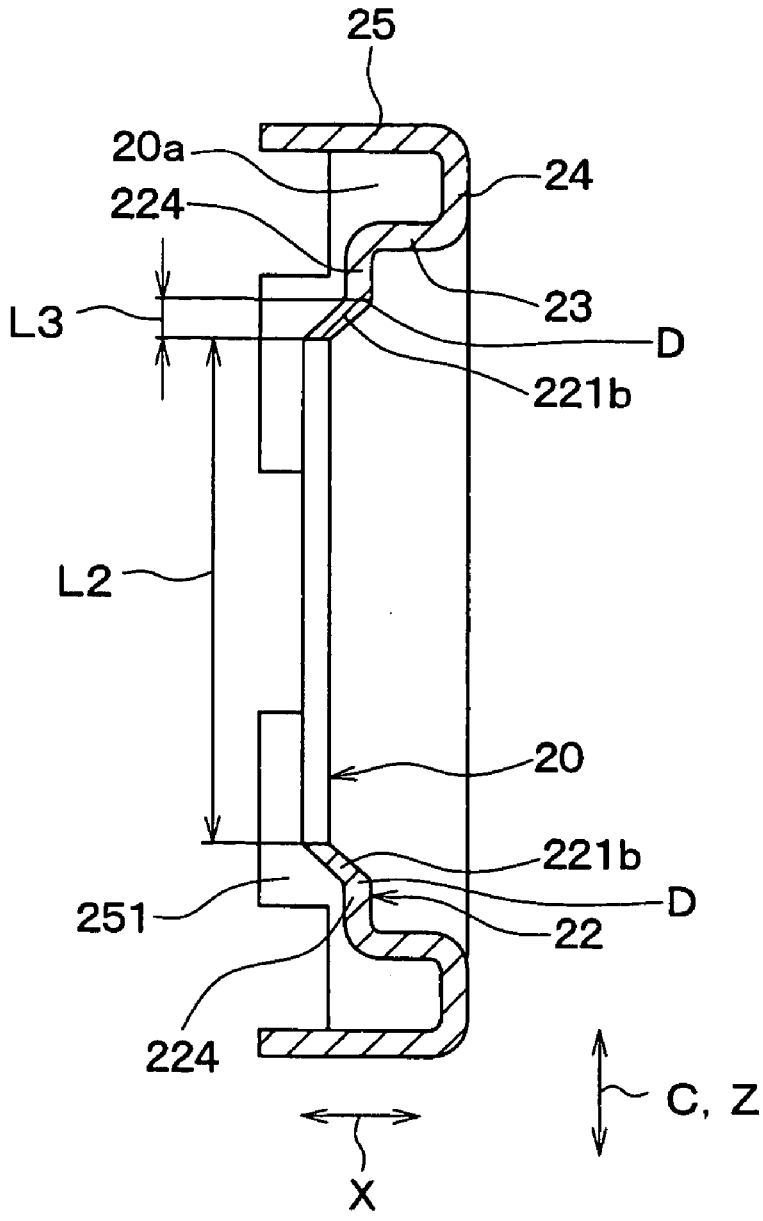
FIG. 13 is a cross-sectional view of a core plate taken along a line in a width direction of tubes in a heat exchanger according to a seventh embodiment of the invention.
Figure 14:
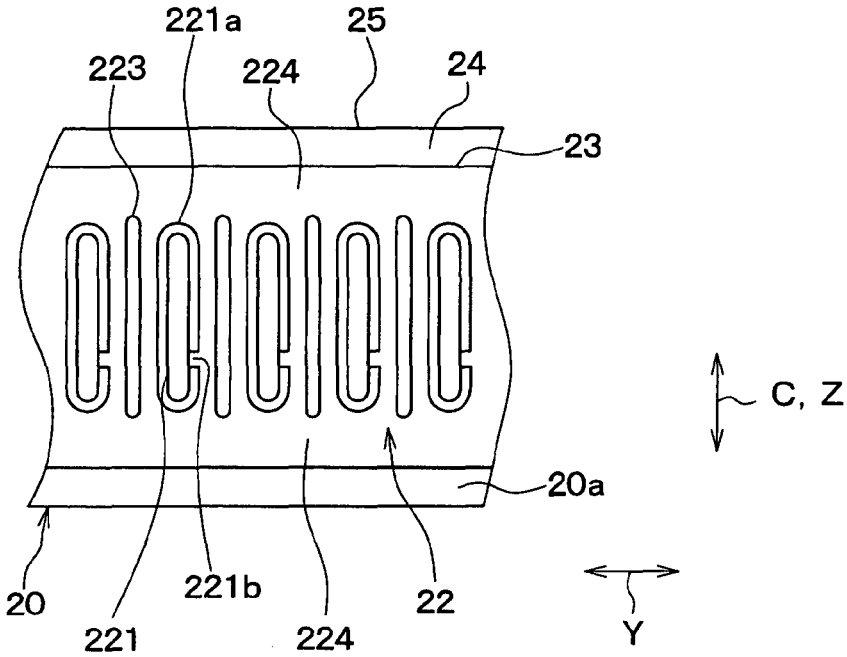
FIG. 14 is a bottom view showing a part of a core plate in a heat exchanger according to an eighth embodiment of the invention.

FIG. 13 is a cross-sectional view of a core plate 20 for a heat exchanger according to a seventh embodiment of the invention, taken along a line in the tube major direction Z. The cut portions 221*b* are inclined toward the flat surfaces 224, i.e., surfaces of the core plate 20 approximately perpendicularly to the tube longitudinal direction X. Specifically, the cut portions 221*b* are inclined in such a manner that inner ends of the cut portions 221*b* being close to center portions of the tube holes 221 are arranged at an inside of each of the tanks 2 and 3 compared with outer ends of the cut portions 221*b*.

When a temperature of one of the tubes 10 is different from that of an adjacent tube 10 and a thermal strain is generated in the tubes 10, connecting points (bending points) D between the flat surface 224 and the cut portions 221*b* are deformed for absorbing the thermal strain. Therefore, a stress concentration at the end portions of the tubes 10 in the tube major direction Z can be restricted.

When the cut portions 221*b* are projected to the surfaces of the core plate 20 approximately perpendicularly to the tube longitudinal direction X, a ratio of a length L3 of the projected cut portions 221*b* to the length L2 of the tube holes 221 is set to be about in a range of $0.05 \leqq (L3/L2) \leqq 0.3$. Thereby, a stress concentration at the end portions of the tubes 10 in the tube major direction is restricted while the formability of the core plate 20 is improved.

When a value of the ratio (L3/L2) is smaller than 0.05, the connecting points D between the flat surfaces 224 and the cut portions 221*b* are difficult to be formed. In addition, when a thermal strain is generated in the tubes 10, the connecting points D are difficult to be deformed, and may not absorb the thermal strain. In contrast, when the value of the ratio (L3/L2) is larger than 0.3, distances between the ends of the tubes 10 in the tube major direction Z and the connecting points D become long, thereby the connecting points D may not absorb a thermal strain in the tubes 10.

Eighth Embodiment

The cut portions 221*b* in FIGS. 11-13 are provided at the portions of the burring parts 221*a* corresponding to the arc portions 10*b* of the tubes 10. Alternatively, each of the burring parts 221*a* may be provided with one cut portion 221*b* at a portion corresponding to the straight portions 10*a* of the tubes 10. In this case, each of the cut portions 221*b* is provided at approximately same portions of each of the burring parts 221. Thereby, the burring parts 221*a* are restricted from cracking in the press working, while the formability of the core plate 20 is improved.

Ninth Embodiment

Figure 15:
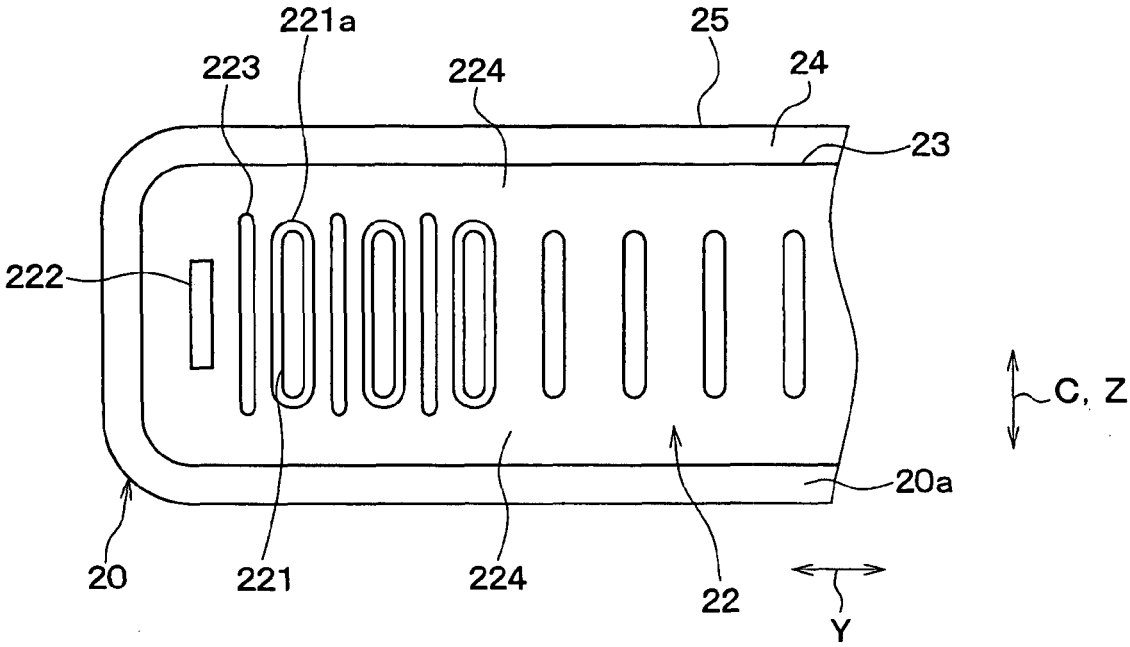
FIG. 15 is a bottom view showing a part of a core plate in a heat exchanger according to a ninth embodiment of the invention.

In the core plate 20 shown in FIGS. 9A-14, the burring parts 221*a* are arranged at each of the tube holes 221. Alternatively, the burring parts 221*a* may be arranged at only a part of the tube holes 221 in the vicinity of the two ends of the core plate 20 in the tube stacking direction Y. For example, the burring parts 221*a* may be arranged only at the first to third tube holes 221 counted from the two ends of the core plate 20 in the tube stacking direction Y, as shown in FIG. 15. In this case, the ribs 223 may be arranged at intermediate portions between the first to third tube holes 221, and between the insert holes 222 and the first tube holes 221.

Generally, a thermal strain due to a difference in a temperature of the tubes 10 may be generated in a part of the tubes 10 arranged at both end sides in the tube stacking direction Y. Therefore, when the burring parts 221*a* and the ribs 223 are arranged partially only in the vicinity of the two ends of the core plate 20 in the tube stacking direction Y, a stress concentration at the end portions of the tubes 10 is restricted effectively.

In addition, the burring parts 221*a* and the ribs 223 may be not required to be arranged in a middle portion of the core plate 20 in the tube stacking direction Y, thereby the formability of the core plate 20 is improved.

When a number of the tubes 10 is not less than thirty, "the vicinity of the both ends of the core plate 20" is set to be a range in which three to five tube holes 221 are arranged from the two ends of the core plate 20 in the tube stacking direction Y. The number of the tube holes 221, to which the burring part 221*a* are provided, may be suitably set in accordance with the state of the core plate 20, such as its length, the total number of the tube holes 221, sizes of the tube holes 221.

Tenth Embodiment

A core plate 20 for a heat exchanger according to a tenth embodiment of the invention will be described with reference to FIGS. 16-18. The tube holes 221 have first and second end portions in the tube major direction Z. The ribs 223 may be arranged in the tube insertion plate part 22 to protrude outside in the tube major direction Z by a predetermined length (protruding length) L4 compared with at least one of the first and second end portions of the tube holes 221, and to provide the flat surfaces 224. The flat surfaces 224 are located in the tube insertion plate part 22 outside of the ribs 223 in the tube major direction Z.

Figure 18:
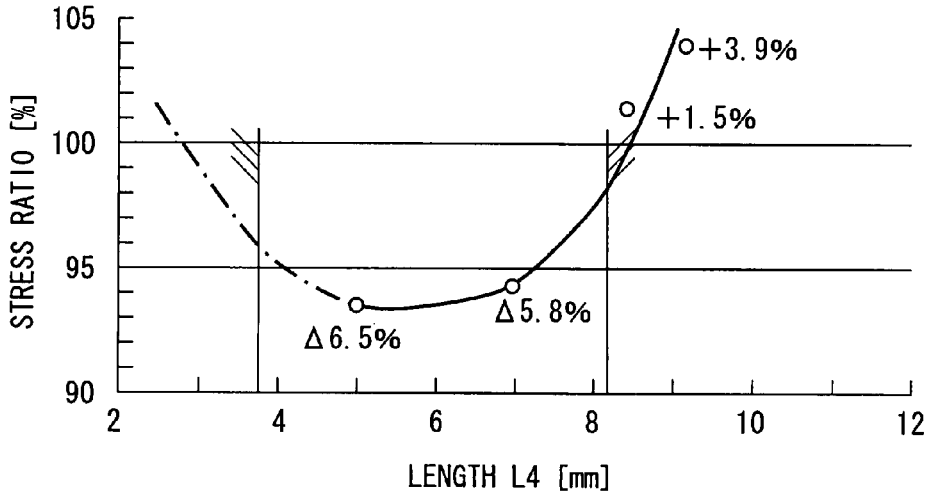
FIG. 18 is a graph showing a relationship between a protruding length L4 of ribs in the core plate and a stress ratio at end portions of tubes in a tube major direction compared with a case without any ribs.
Figure 19:
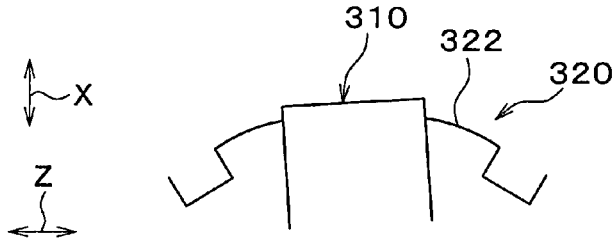
FIG. 19 RELATED ART
FIG. 19 is a schematic diagram showing a core plate and a tube in a heat exchanger according to a related art.
Figure 20:
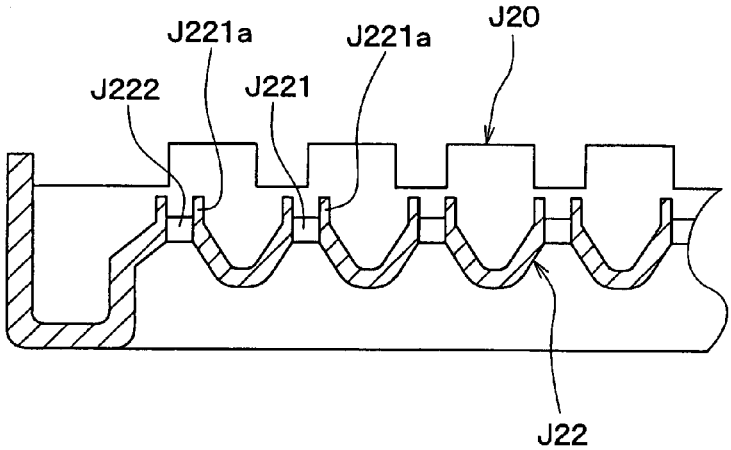
FIG. 20 RELATED ART
FIG. 20 is a cross-sectional view of a core plate in a heat exchanger according to related art.

FIG. 18 is a graph showing a relationship between the protruding length L4 of the ribs 223 and a stress ratio at the end portions of the tubes 10 in the tube major direction Z, compared with a case without any ribs 223. When the protruding length L4 is set to be about in a range of 4 to 8 mm, the stress ratio is reduced. In addition, a thermal strain in the tubes 10 may be absorbed by a deformation of the flat surfaces 224 located outside of the ribs 223 in the tube major direction Z.

Figure 16:
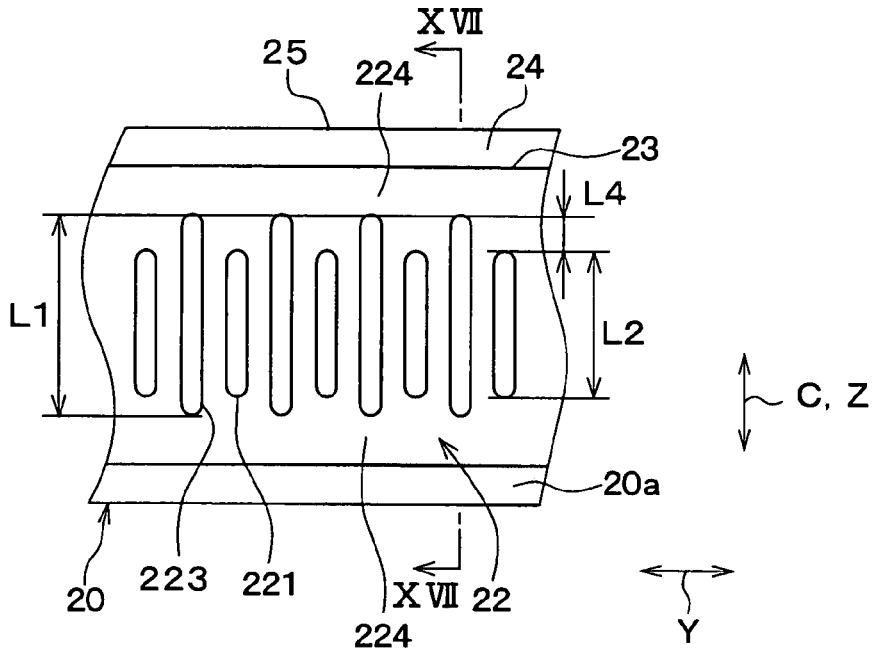
FIG. 16 is a bottom view showing a part of a core plate in a heat exchanger according to a tenth embodiment of the invention.
Figure 17:
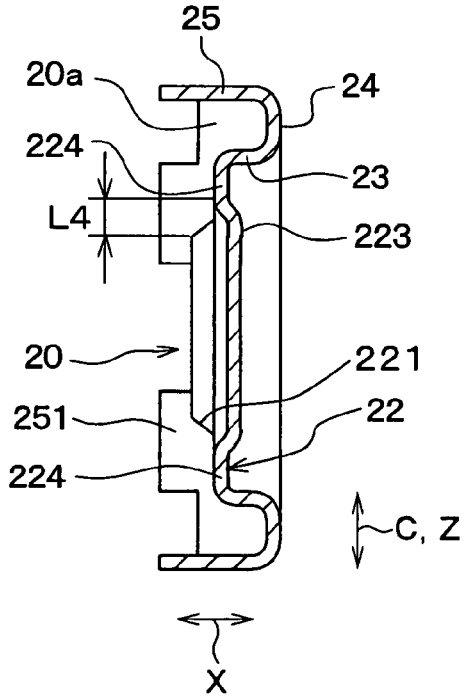
FIG. 17 is a cross-sectional view of the core plate taken along line XVII-XVII in FIG. 16.

In the core plate 20 shown in FIG. 16, each of the intermediate portions between the tube holes 221 and the insert holes 222 in the tube stacking direction Y is provided with one of the ribs 223 which has the length L1 longer than the length L2 of the tube holes 221 in the tube major direction Z. Alternatively, each of the intermediate portions may have a pair of the ribs 223 each of which has the length L1 shorter than the length L2 of the tube holes 221, similarly with those in the first to third embodiments. Also in this case, when the protruding length L4 between each of outer end portions of the ribs 223 in the tube stacking direction Z and an adjacent end portion of the tube holes 221 is set to be about in a range of 4 to 8 mm, a stress concentration at the end portions of the tubes 10 in the tube major direction is restricted.

The protruding length L4 may be suitably set in accordance with the state of the core plate 20, such as its length, and sizes of the tube holes 221.

Other Embodiments

Although the present invention has been fully described in connection with the preferred embodiments thereof with reference to the accompanying drawings, it is to be noted that various changes and modifications will become apparent to those skilled in the art.

For example, the burring parts 221*a* may be arranged in the core plates 20 according to the second to fourth embodiments, and the tenth embodiment. Alternatively, the ribs 223 may be not arranged in the core plates 20 according to the fifth to ninth embodiments. Alternatively, the burring parts 221*a* may be arranged at inner peripheral edges of the insert holes 222.

In the core plate 20 according to the seventh embodiment, the cut portions 221*b* are inclined in such a manner that the inner ends of the cut portions 221*b* being close to the center portions of the tube holes 221 are arranged at the inside of each of the tanks 2 and 3 compared with the outer ends of the cut portions 221*b*. Alternatively, the cut portions 221*b* may be inclined in such a manner that the inner ends of the cut portions 221*b* are arranged at the outside of each of the tanks 2 and 3 compared with the outer ends of the cut portions 221*b*. In this case, the burring parts 221*a* project to the outside of each of the tanks 2 and 3, and the ribs 223 have convex shapes projecting from the tube insertion plate part 22 to the inside of each of the tanks 2 and 3.

In the core plate 20 according to the eighth embodiment, each of the burring parts 221*a* has one cut portion 221*b*. Alternatively each of the burring parts 221*a* may have a plurality of cut portions 221*b*.

In the core plate 20 according to the ninth embodiment, the cut portions 221*b* are not provided at the burring parts 221*a*. Alternatively, the burring parts 221*a* may have the cut portions 221*b*. In addition, the burring parts 221*a* may be arranged at the inner peripheral edges of the insert holes 222. When the cut portions 221*b* are arranged at the portions of the tube holes 221 corresponding to the arc portions 10*b* of the tubes 10, the cut portions 221*b* may be inclined toward the flat surfaces 224.

The ribs 223 and the burring parts 221*a* may be effective not only to a thermal strain but also to a strain of the tubes 10 due to a change of an inner pressure or a vibration of a vehicle, and may restrict a stress concentration at the both end portions of the tubes 10 in the tube major direction Z.

Furthermore, the core plate 20 may be used for a heart exchanger for the other use except for the radiator.

Such changes and modifications are to be understood as being within the scope of the present invention as defined by the appended claims.

What is claimed is:

1. A heat exchanger comprising:

a plurality of tubes each having a flat shape, extending in a first direction, and stacked in only a single row in a second direction; and a tank having a core plate that includes a tube insertion plate part and a groove portion having an inner wall immediately adjacent and entirely around a periphery of the tube insertion plate part and an outer wall spaced from the inner wall and entirely around a periphery of the groove portion, the tube insertion plate part being, arranged at an end portion of the plurality of tubes in the first direction, to communicate with the plurality of tubes, wherein the tank having a tank body which has a flange portion disposed between the inner and outer wall of the groove portion and fixed to the groove portion of the core plate to define a tank space in communication with each of the plurality of tubes:

a plurality of projection pieces formed at an end of the outer wall, each of the plurality of projection pieces being deformed to engage the flange portion of the tank body;

the tube insertion plate part has a plurality of tube holes stacked in only a single row in which the plurality of tubes are inserted, and a plurality of ribs each of which extends in a third direction that is approximately perpendicular to the first direction and the second direction, each tube hole has a flat hole shape in cross-section with a major diameter dimension in the third direction and a minor diameter dimension in the second direction;

each of the plurality of ribs protrudes from a flat surface of the tube insertion plate part and has a length in the third direction that is shorter than a length of each of the plurality of tube holes in the third direction;

the tube holes have first and second hole end portions in the third direction;

the ribs are arranged in the tube insertion plate part to overlap with each of the first and second hole end portions in the second direction, and to define a deformable part of the flat surface of the tube insertion plate part to be deformable in the first direction, the flat surface of the tube insertion plate part extending entirely between adjacent ribs in the third direction;

the deformable part is the flat surface and is located in the tube insertion plate part outside of the ribs in the third direction;

each rib has a first rib end and a second rib end in the third direction, each of the first rib ends is positioned closer to the inner wall of the groove portion than the second rib end and each of the second rib ends is positioned closer to a center of the flat surface than the first rib end;

only the deformable part is provided between the first rib end and the inner wall, and between each of the first and second hole end portions of the tube holes and the inner wall, in the third direction;

each first rib end protrudes from a respective first or second hole end portion of the tube hole by a predetermined dimension in the third direction, that is in a range of 4 to 8 mm; and the deformable part between each of the first rib ends and the inner wall of the groove portion has a length that is shorter than a length of the deformable part between each of the first and second hole end portions of the tube holes and the inner wall of the groove portion in the third direction.

2. The heat exchanger according to claim 1, wherein:

the ribs are arranged at intermediate portions between all adjacent tube holes.

3. The heat exchanger according to claim 1, wherein:

the ribs are arranged in a part of intermediate portions between all adjacent tube holes.

4. The heat exchanger according to claim 3, wherein:

the intermediate portions includes first intermediate portions in which the ribs are arranged and second intermediate portions without the ribs.

5. The heat exchanger according to claim 4, wherein:

the first intermediate portions and the second intermediate portions are alternately arranged in the second direction.

6. The heat exchanger according to claim 4, wherein:

one of the first intermediate portions and two of the second intermediate portions are alternately arranged in the second direction.

7. The heat exchanger according to claim 1, wherein:

the ribs are arranged at intermediate portions between adjacent tube holes;

the intermediate portions includes first intermediate portions in which the ribs are arranged only at a side of the first hole end portions, and a second intermediate portions in which the ribs are arranged only at a side of the second hole end portions; and the first intermediate portions and the second intermediate portions are alternately arranged in the second direction.

8. The heat exchanger according to claim 1, wherein the flat surface of the tube insertion plate part is coplanar with the deformable part.

9. The heat exchanger according to claim 1, wherein:

the tube holes are aligned in the second direction; and the ribs are overlapped with first and second hole end portions of the aligned tube holes in the second direction.

10. The heat exchanger according to claim 9, wherein the plurality of tube holes define a plurality of rows of tube holes aligned in the second direction, each row of tube holes defining only one tube hole.

11. The heat exchanger according to claim 1, wherein a ratio (L1) of a length of each rib in the third direction to a length (L2) of each tube hole in the third direction is set in a range of $0.08 \leqq (L1/L2) \leqq 0.20$.

12. A heat exchanger comprising:

a core part which includes a plurality of tubes each having a flat shape, extending in a first direction, and stacked in only a single row in a second direction; and a tank arranged at an end portion of the plurality of tubes in the first direction, the tank having a core plate connected to the plurality of tubes and a tank body arranged to form a tank space with the core plate, the tank space being in communication with each of the plurality of tubes, wherein:

the core plate has a tube insertion plate part and a groove portion having an inner wall immediately adjacent and entirely around a periphery of the tube insertion part and an outer wall spaced from the inner wall and entirely around a periphery of the groove portion, the tube insertion plate part having a plurality of burring parts located at inner peripheral edges of at least a part of the tube holes, the tank body having a flange portion disposed between the inner and outer walls of the groove portion and fixed to the groove portion;

a plurality of projection pieces formed at an end of the outer wall, each of the plurality of projection pieces being deformed to engage the flange portion of the tank body;

the tube insertion plate part has a plurality of tube holes stacked in only a single row in which the plurality of tubes are inserted, and a plurality of ribs each of which extends in a third direction that is approximately perpendicular to the first direction and the second direction, each tube hole has a flat hole shape in cross-section with a major diameter dimension in the third direction and a minor diameter dimension in the second direction;

each of the plurality of ribs protrudes from a flat surface of the tube insertion plate part and has a length in the third direction that is shorter than a length of each of the plurality of tube holes in the third direction;

the tube holes have first and second hole end portions in the third direction;

the ribs are arranged in the tube insertion plate part to overlap with each of the first and second hole end portions in the second direction, and to define a deformable part of the flat surface of the tube insertion plate part to be deformable in the first direction, the flat surface of the tube insertion plate part extending entirely between adjacent ribs in the third direction;

the deformable part is the flat surface and is located in the tube insertion plate part outside of the ribs in the third direction;

each rib has a first rib end and a second rib end in the third direction, each of the first rib ends is positioned closer to the inner wall of the groove portion than the second rib end and each of the second rib ends is positioned closer to a center of the flat surface than the first rib end;

only the deformable part is provided between the first rib end and the inner wall, and between each of the first and second hole end portions of the tube holes and the inner wall, in the third direction;

each first rib end protrudes from a respective first or second hole end portion of the tube hole by a predetermined dimension in the third direction, that is in a range of 4 to 8 mm;

the deformable part between each of the first rib ends and the inner wall of the groove portion has a length that is shorter than a length of the deformable part between each of the first and second hole end portions of the tube holes and the inner wall of the groove portion in the third direction;

each burring part protrudes from a flat surface of the core plate in the first direction; and each inner peripheral edge has a cut portion where a part of a respective burring part has been cut and removed, the cut portion extending to the flat surface of the core plate; wherein each of the tubes includes a pair of opposite straight portions and a pair of opposite arc portions in cross-section approximately perpendicular to the first direction;

the pair of opposite straight portions is arranged to be approximately parallel;

the pair of opposite arc portions is arranged to connect ends of the pair of opposite straight portions; and the cut portion is only located at portions of the tube holes corresponding to the arc portions of the tubes in the entire areas of the arc portions.

13. The heat exchanger according to claim 12, wherein:

the cut portion is inclined toward a surface of the core plate, approximately perpendicular to the first direction.

14. The heat exchanger according to claim 13, wherein:

the tube hole has a length L2 in a third direction that is approximately perpendicular to the first direction and the second direction;

the cut portion has a projected length L3, when being projected on the surface of the core plate;

a ratio of the projected length L3 of the cut portion to the length L2 of the tube hole is set to be about in a range of $0.05 \leqq (L3/L2) \leqq 0.3$.

15. The heat exchanger according to claim 12, wherein:

each of the tubes includes a pair of opposite straight portions and a pair of opposite arc portions in cross-section approximately perpendicular to the first direction;

the pair of opposite straight portions is arranged to be approximately parallel;

the pair of opposite arc portions is arranged to connect ends of the pair of opposite straight portions; and the cut portion is located at least at a portion of the tubes holes corresponding to the straight portions of the tubes.

16. The heat exchanger according to claim 12, wherein:

the burring part and the cut portion are arranged at only a part of the tube holes, which is arranged in the vicinity of two ends of the core plate in the second direction.

17. The heat exchanger according to claim 12, further comprising:

an insert arranged at an end portion of the core part approximately parallel to the first direction, wherein an end of the insert is connected to the core plate to reinforce the core part, wherein:

the insert is inserted in the insert hole to be connected to the core plate.

18. The heat exchanger according to claim 17, wherein:

the burring part is arranged at only a part of the tube holes, which is arranged in the vicinity of two ends of the core plate in the second direction.

19. The heat exchanger according to claim 12, wherein:

the tube insertion plate part has a plurality of ribs extending in a third direction that is approximately perpendicular to the first direction and the second direction.

20. The heat exchanger according to claim 19, wherein:

the ribs are arranged in the vicinity of two ends of the core plate in the second direction.

21. A heat exchanger comprising:

a plurality of flat tubes, each tube extending in a first direction, the plurality of tubes being stacked in a second direction to define a plurality of rows of tubes, each row of tubes having only one flat tube;

a tank having a core plate that includes a tube insertion plate and a groove portion having an inner wall immediately adjacent and entirely around a periphery of the tube insertion plate part and an outer wall spaced from the inner wall and entirely around a periphery of the groove portion, the tube insertion plate part being arranged at an end of the plurality of flat tubes in the first direction the tank having a tank body which has a flange portion disposed between the inner and outer wall of the groove portion and fixed to the groove portion of the core plate to define a tank space in communication with each of the plurality of tubes; wherein a plurality of projection pieces formed at an end of the outer wall, each of the plurality of projection pieces being deformed to engage the flange portion of the tank body;

the tube insertion plate defines a plurality of tube holes stacked in only a single row extending in a third direction, the plurality of tube holes being stacked in the second direction to define a plurality of rows of tube holes, each row of tube holes having only one tube hole, each flat tube being inserted into a respective tube hole;

the tube insertion plate defines a plurality of ribs extending in the third direction, the plurality of ribs being stacked in the second direction to define a plurality of rows of ribs, each row of ribs having only two ribs, each row of ribs being disposed between adjacent rows of tube holes;

each of the plurality of ribs protrude from a flat surface of the tube insertion plate in the second direction, each of the plurality of ribs has a length in the third direction that is shorter than a length of the tube holes in the third direction;

each of the tube holes have a first and a second end portion in the third direction;

each rib has a first end disposed between one of the first and second end portions of the tube holes and a side of the tube insertion plate and a second end disposed between the first and second end portions of the tube holes, each of the first ends of the ribs is positioned closer to the inner wall of the groove portion than the second rib end and each of the second rib ends is positioned closer to a center of the flat surface than the first rib end;

a deformable part of the flat surface of the tube insertion plate is defined between the first end of each rib and the side of the tube insertion plate;

only the deformable part is provided between the first rib end and the inner wall, and between each of the first and second hole end portions of the tube holes and the inner wall, in the third direction;

each first rib end protrudes from a respective first or second hole end portion of the tube hole by a predetermined dimension in the third direction, that is in a range of 4 to 8 mm; and the deformable part between each of the first rib ends and the inner wall of the groove portion has a length that is shorter than a length of the deformable part between each of the first and second hole end portions of the tube holes and the inner wall of the groove portion in the third direction.

22. A heat exchanger comprising:

a plurality of tubes each having a flat shape, extending in a first direction, and stacked in only a single row in a second direction; and a tank having a core plate that includes a tube insertion plate part and a groove portion having an inner wall immediately adjacent and entirely around a periphery of the tube insertion plate part and an outer wall spaced from the inner wall and entirely around a periphery of the groove portion, the tube insertion plate part being, arranged at an end portion of the plurality of tubes in the first direction, to communicate with the plurality of tubes, wherein the tank having a tank body which has a flange portion disposed between the inner and outer wall of the groove portion and fixed to the groove portion of the core plate to define a tank space in communication with each of the plurality of tubes:

a plurality of projection pieces formed at an end of the outer wall, each of the plurality of projection pieces being deformed to engage the flange portion of the tank body;

the tube insertion plate part has a plurality of tube holes stacked in only a single row in which the plurality of tubes are inserted, and a plurality of ribs each of which extends in a third direction that is approximately perpendicular to the first direction and the second direction, each tube hole has a flat hole shape in cross-section with a major diameter dimension in the third direction and a minor diameter dimension in the second direction;

each of the plurality of ribs protrudes from a flat surface of the tube insertion plate part and has a length in the third direction that is shorter than a length of each of the plurality of tube holes in the third direction;

the tube holes have first and second hole end portions in the third direction;

the ribs are arranged in the tube insertion plate part to overlap with each of the first and second hole end portions in the second direction, and to define a deformable part of the flat surface of the tube insertion plate part to be deformable in the first direction, the flat surface of the tube insertion plate part extending entirely between adjacent ribs in the third direction;

the deformable part is the flat surface and is located in the tube insertion plate part outside of the ribs in the third direction;

each rib has a first rib end and a second rib end in the third direction, each of the first rib ends are is positioned closer to the inner wall of the groove portion than the second rib end and the second rib end is positioned closer to a center of the flat surface than the first rib end;

only the deformable part is provided between the first rib end and the inner wall, and between each of the first and second hole end portions of the tube holes and the inner wall, in the third direction;

the deformable part between each of the first rib ends and the inner wall of the groove portion has a length that is shorter than a length of the deformable part between each of the first and second hole end portions of the tube holes and the inner wall of the groove portion in the third direction.

* * * * *